US005917468A

United States Patent [19]

Han

[11] Patent Number: 5,917,468

[45] Date of Patent: Jun. 29, 1999

[54] APPARATUS FOR CONTROLLING AN OPERATION OF A DISPLAY DATA CHANNEL IN A MONITOR AND A METHOD THEREOF

[75] Inventor: Choon Deok Han, Woelsung-Dong, Rep. of Korea

[73] Assignee: LG Electronics Inc., Seoul, Rep. of Korea

[21] Appl. No.: 08/743,641

[22] Filed: Nov. 4, 1996

[30] Foreign Application Priority Data

Jan. 15, 1996 [KR] Rep. of Korea ..... 96-661

[51] Int. Cl.[6] ..... G09G 5/00

[52] U.S. Cl. ..... 345/112; 345/204; 345/214

[58] Field of Search ..... 345/10, 11, 204, 345/211, 212, 214, 112

[56] References Cited

U.S. PATENT DOCUMENTS

| | | | |
|---|---|---|---|
| 5,270,821 | 12/1993 | Samuels | 345/156 |
| 5,315,695 | 5/1994 | Saito et al. | 345/12 |
| 5,396,593 | 3/1995 | Mori et al. | 345/501 |
| 5,457,473 | 10/1995 | Arai et al. | 345/10 |
| 5,465,106 | 11/1995 | Keech et al. | 345/204 |
| 5,602,567 | 2/1997 | Kanno | 345/132 |
| 5,675,364 | 10/1997 | Stedman et al. | 345/211 |

FOREIGN PATENT DOCUMENTS

| | | |
|---|---|---|
| 2302489 | 1/1997 | United Kingdom . |
| WO9530634 | 11/1995 | WIPO . |
| 2299002 | 9/1996 | WIPO . |

*Primary Examiner*—Mark K. Zimmerman
*Assistant Examiner*—Vincent E. Kovalick
*Attorney, Agent, or Firm*—Oppenheimer Wolff & Donnelly LLP

[57] ABSTRACT

An apparatus for controlling the operation of a display data channel part of a monitor so that a personal computer (PC) with DDC function is compatible with a personal computer without DDC function and a method thereof. The apparatus includes a voltage switch for controlling the voltage supplied to the IC, a microcomputer for controlling the voltage switch, an electrically erasable programmable read only memory for storing information in relation to the operation of the DDC part, which is performed by the microcomputer and for providing the stored information to the microcomputer, a key input part connected to the microcomputer and to which selection data for selecting whether or not the operation of DDC part is performed is applied, an on screen display (OSD) processor receiving the selection data from the microcomputer to produce OSD data in response to the selection data, an image display for changing data outputted from the OSD processor to a video signal and a color picture tube(CPT) receiving the result of the image display.

9 Claims, 2 Drawing Sheets

APPARATUS FOR CONTROLLING AN OPERATION OF A DISPLAY DATA CHANNEL IN A MONITOR AND A METHOD THEREOF

BACKGROUND OF THE INVENTION

1. Field of the Invention

The present invention relates to an apparatus for controlling an operation of a display data channel(DDC) of a monitor so that a personal computer (PC) with DDC function is compatible with a personal computer without DDC function and a method thereof.

2. Description of the Prior Art

FIG. 1 shows a scheme of an integrated circuit(IC) performing DDC function.

If power is applied to a monitor, data of the monitor is successively transmitted to a PC (not shown) connected thereto through a data port SDA of the IC 1 by one byte. In this time, a clock port SCL of the IC is in logic "high" and a vertical synchronization signal is applied from the PC to a port VCLK of IC 1. On the other hand, if the logic state of the clock port SCL is converted from logic "high" to logic "low", an operation mode of the IC 1 is changed. In the changed operation mode, the IC 1 receives a read signal of $I^2C$ type at the ports SCL and SDA from the PC and on receiving the read signal, data of the monitor is transmitted to the PC synchronized with a clock of the port SCL.

In case a monitor with DDC function, however, is connected to the PC without DDC function, data of the monitor with DDC function is not detected by the PC without DDC function. That is, in using the monitor with DDC function, the PC with DDC function is not compatible with the PC without DDC.

SUMMARY OF THE INVENTION

Accordingly, an object of the present invention is to provide an apparatus for controlling an operation of a display data channel so that a compatibility between a PC with the DDC function and a PC without the DDC function is secured in using a monitor with the DDC function and a method thereof.

According to the object of the present invention, there is provided an apparatus for controlling an operation of a display data channel part installed in a monitor, comprising means for determining an operation state of the display data channel part and means for enabling or disabling the operation of said display data channel part responsive to an output of the determining means. The determining means comprises a key input means to which a selection data showing the operation state of the display data channel part is applied and means for displaying an on-screen-display data in accordance with the selection data in a video form. The enabling/disabling means comprises means for storing the selection data, a micro computer for generating a control signal in accordance with the data stored in the storing means and means for controlling a supply of power voltage to the display data channel part responsive to the control signal from the micro computer, whereby the operation state of the display data channel part is controlled. The storing means, maintaining a previous data stored therein even if power of the monitor is out, is of an electrically erasable programmable read only memory. Also, the power supply controlling means comprises a transistor turned on/off according to the control signal outputted from the micro computer.

According to another object of the present invention, there is provided a method for controlling an operation of a display data channel part installed in a monitor, comprising the steps of (a) analyzing a data stored in a storing means if a power is supplied to the monitor, (b) enabling/disabling the display data channel part in accordance with the analyzed data, (c) applying an input data representing a new operation state of the display data channel part to a key input means in case there is an intention to change the operation state of the display data channel part, (d) storing the input data in the storing means and providing step (a) with the input data as the stored data and (e) enabling/disabling the display data channel part in accordance with the input data. The enabling/disabling step in steps (b) and (e) is accomplished by controlling the power supply to the display data channel part.

BRIEF DESCRIPTION OF THE INVENTION

The advantages and object of the present invention will become apparent by explaining the preferred embodiment of the present invention referring to the attached drawings.

DETAILED DESCRIPTION OF THE EMBODIMENT

Figure 2:
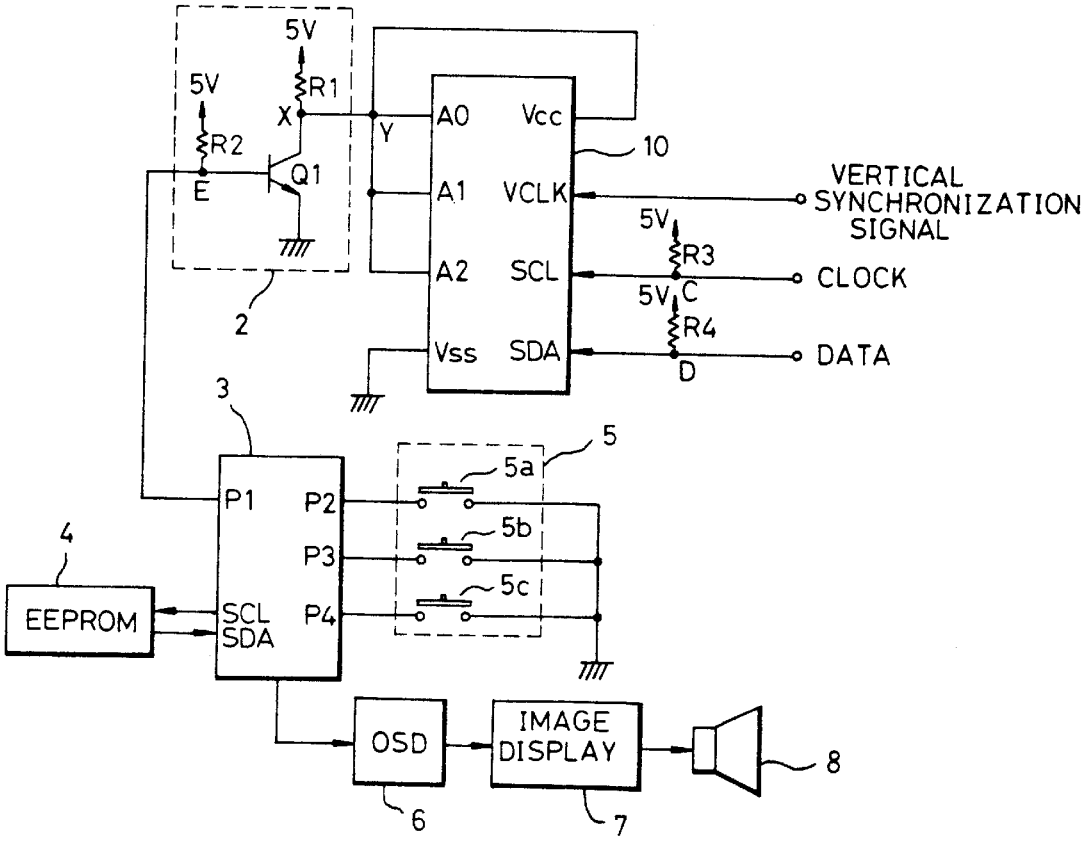
FIG. 2 illustrates an apparatus for controlling an operation of a display data channel part installed in a monitor in accordance with the present invention.

Referring to FIG. 2, an apparatus for controlling the operation of a display data channel part includes a voltage switch 2 for controlling supply of the voltage to the IC, a microcomputer 3 for controlling the voltage switch 2, an electrically erasable programmable read only memory (EEPROM) 4 for storing information in relation to the operation of the DDC part, which is performed by the microcomputer 3 and for providing the stored information to the microcomputer 3, a key input part 5 connected to the microcomputer 3 and to which a selection data for selecting whether the operation of DDC part is performed or not is applied, an on screen display (OSD) processor 6 receiving the selection data from the microcomputer 3 to produce OSD data in response to the selection data, an image display 7 for changing data outputted from the OSD processor 6 to a video signal and a color picture tube (CPT) 8 receiving the result of the image display 7. Here, instead of EEPROM 4, even if the power of the monitor is out, memory capable of maintaining the previously stored data can be used. The voltage switch 2 has a transistor Q1 formed between the supply voltage Vcc and the ground Vss and turned on/off in accordance with the logical signal level provided from the microcomputer 3 and two resistors R1 and R2. The key input part 5 includes an OSD menu key 5*a* for displaying a menu on which whether or not the operation of DDC part is performed is displayed, a first command key 5*b* to which an input representing a command to perform the operation of DDC part is applied and a second command key 5*c* to which an input representing a command not to perform the operation of DDC part is applied.

First, a basic principle for controlling the operation of DDC part installed in the monitor is below. If the PC without DDC function is connected to the monitor with DDC, since information of the monitor is not detected, a user buttons the OSD menu key 5*a* of the key input part 5 and then selects the second command key 5*c* for disabling the operation of DDC part. On the other hand, if the PC with DDC function is connected to the monitor with DDC function, the user selects the OSD menu key 5*a* and the first command key 5*b*. The information determined according to the selection of the first or second command keys is stored in EEPROM 4 and thereafter is used as an initial data being read from the EEPROM 4 when the power is resupplied to the monitor.

Figure 3:
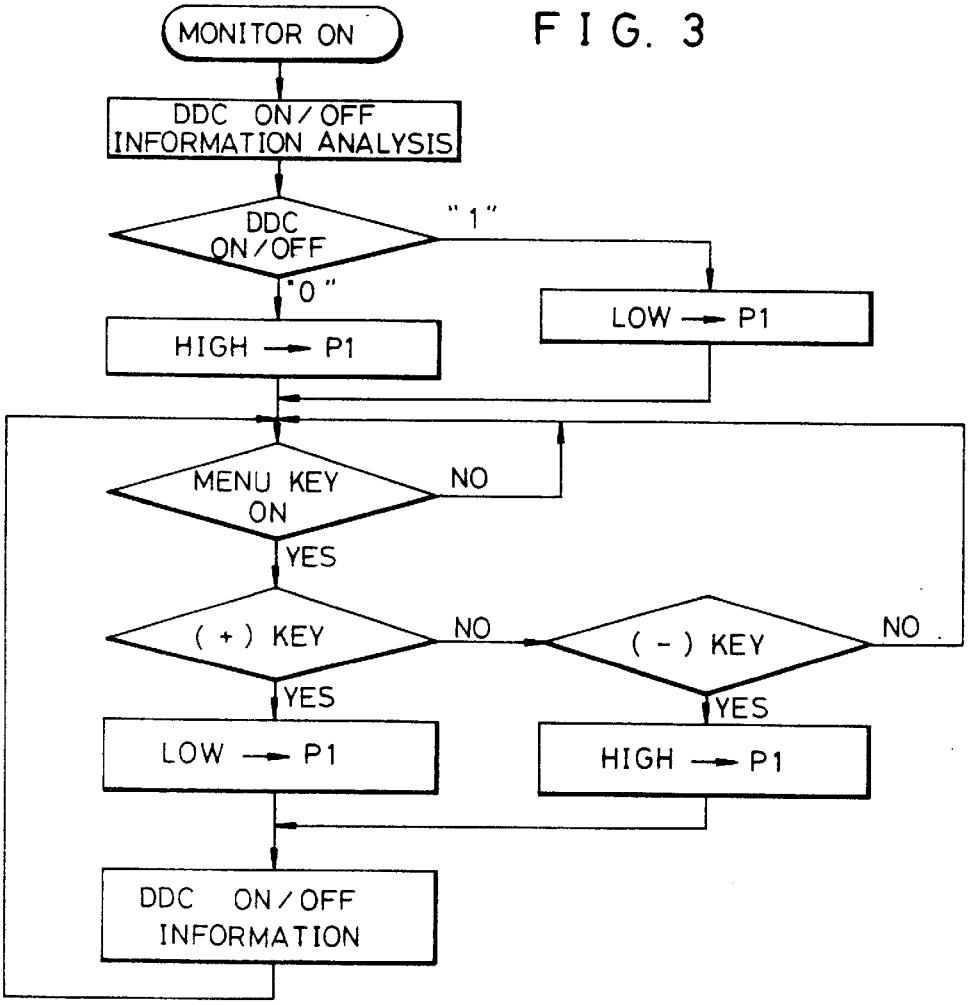
FIG. 3 is a flow chart for controlling an operation of a display data channel part installed in a monitor in accordance with the present invention.

Referring to FIG. 3, if the power is supplied to the monitor connected to the PC, the microcomputer 3 provides clock to EEPROM 4 through the clock port SCL, reads the data stored in EEPROM 4 through the data port SDA and analyses the read data. If the analyzed data is logic "0", the microcomputer 3 generates logic "high" signal at a port P1 and provides the transistor Q1 of the voltage switch 2 with the logic "high" signal. The transistor Q1 is turned on and 5 V supplied through the resistor R1 is ground to cut the voltage supply to the IC 10 through nodes X and Y. Accordingly, the IC does not operates, disabling the operation of the DDC part. In this time, the nodes C and D on the clock port SCL and the data port SDA maintain the logic "high" by 5 V connected to the resistors R3 and R4. Accordingly, data of the monitor is transmitted to the PC through the data port SDA. That is, it is possible to detect the information of the monitor by disabling the operation of the DDC part regradless of the DDC function of the PC. Therefore, the problem generated by using the PC without DDC function can be sufficiently solved.

Figure 1:
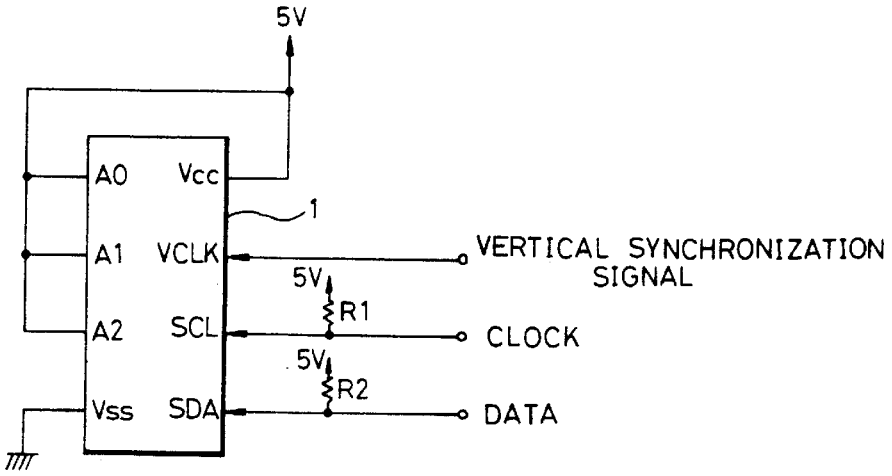
FIG. 1 (PRIOR ART)
FIG. 1 shows a general construction of IC performing a display data channel function.

On the other hand, if the analyzed data is logic "1", the microcomputer 3 generates a logic "low" signal at the port P1 thereof and furnishes the logic "low" signal to the transistor Q1 of the voltage switch 2. The transistor Q1 is turned off and therefore 5V connected to the resistor R1 is supplied to the IC 10 through the nodes X and Y. Accordingly, the IC 10 is driven to perform the DDC function as described in a part relating to FIG. 1.

If the modification of the operating state of the DDC part is intended, that is, changing the PC with DDC to the PC without DDC function and vice versa, the method described before the explanation of FIG. 3 is used. The OSD menu key 5*a* of the key input part 5 is selected at the enabling or disabling of the DDC operation and thereafter the user selects one of the first command key 5*b* and the second command key 5*c*. The port P1 of the microcomputer produces a logic "high" or "low" signal to the voltage switch 2 in accordance with the selected command key, altering the operation state of the DDC part. The information in relation to the operation of the DDC part, which is inputted by the user to the key input part 5, is stored in EEPROM and used as an initial control data of the IC 10 when the power is again applied to the monitor. In detail, in case that the user selects the first command key 5*b*, the logic data "1" is stored in EEPROM 4 and read out when the power is again applied to the monitor, enabling the IC 10. In case the user selects the second command key 5*c*, the logic data "0" is stored in EEPROM 4 and read out when the power is again applied to the monitor, disabling the IC 10. Therefore, the PC without DDC is compatible with the PC with DDC.

As described above, in using the apparatus for controlling the operation of the DDC part, since the user can determine the operation state of the DDC part by using the displayed OSD menu, various information of the monitor such as the kind of the monitor is normally sensed through the data port SDA of the IC 10 performing the DDC function even if the monitor with DDC function is connected to the PC without DDC function.

What is claimed is:

1. An apparatus for controlling an operation of a display data channel (DDC) part installed in a monitor, said apparatus comprising:

means for determining an operation state of said display data channel part; and means for enabling or disabling said display data channel part responsive to an output of said determining means, such that said monitor is made compatible with a personal computer (PC) which is not equipped with DDC capability by disabling said display data channel part.

2. An apparatus as claimed in claim 1, wherein said determining means comprises:

a key input means to which a selection data showing said operation state of said display data channel part is applied; and means for displaying an on-screen-display data in a video form in accordance with said selection data.

3. An apparatus as claimed in claim 1, wherein said enabling/disabling means comprises:

means for storing a selection data showing said operation state of said display data channel part;

a microcomputer for generating a control signal in accordance with the data stored in said storing means; and means for controlling a supply of a power to said display data channel part responsive to said control signal from said microcomputer, whereby said operation state of said display data channel part is controlled.

4. An apparatus as claimed in claim 1, wherein said enabling/disabling means comprises:

means for storing said selection data;

a microcomputer for generating a control signal in accordance with the data stored in said storing means; and means for controlling a supply of a power voltage to said display data channel party responsive to said control signal from said microcomputer, whereby said operation state of said display data channel part is controlled by applying or removing power to said display data channel part according to commands received from said key input means.

5. An apparatus as claimed in claim 4, said storing means is a memory maintaining a previous data stored therein even if said power of said monitor is out.

6. An apparatus as claimed in claim 5, said memory is an electrically erasable programmable read only memory.

7. An apparatus as claimed in claim 3, wherein said power supply controlling means comprises a transistor turned on/off according to said control signal from said microcomputer.

8. A method for controlling an operation state of a display data channel (DDC) part installed in a monitor, said method comprising the steps of:

(a) analyzing data stored in a storing means if power is supplied to said monitor;

(b) enabling/disabling said display data channel part in accordance with the analyzed data;

(c) applying an input data representing a new operation state of said display data channel part to a key input means in case there is an intention to change said operation state of said display data channel part;

(d) storing said input data in said storing means and providing step (a) with said input data as the stored data; and (e) enabling/disabling said display data channel part in accordance with said input data;

whereby said monitor may be made compatible with a personal computer (PC) which is not DDC equipped.

9. A method as claimed in claim 8, wherein the enabling/disabling step in steps (b) and (e) is accomplished by controlling a power supply to said display data channel part.

* * * * *